United States Patent [19]

Liautaud

[11] 4,012,798

[45] Mar. 22, 1977

[54] PORTABLE EMERGENCY EYE WASH FOUNTAIN

[76] Inventor: John R. Liautaud, 1537 Churchill Road, Schaumburg, Ill. 60172

[22] Filed: Sept. 29, 1975

[21] Appl. No.: 617,837

[52] U.S. Cl. ..... 4/166; 128/66; 128/249; 239/16; 239/31

[51] Int. Cl.[2] ..... A47K 3/18; A61H 35/00

[58] Field of Search ..... 128/66, 227, 229, 249; 4/166, 167; 239/16, 17, 28, 31, 32

[56] References Cited

UNITED STATES PATENTS

| | | | |
|---|---|---|---|
| 261,021 | 7/1882 | Miller | 4/167 X |
| 1,115,740 | 11/1914 | Rowe | 4/167 |
| 1,697,229 | 1/1929 | DeMott | 128/227 |
| 2,482,960 | 9/1949 | Benson | 4/166 |
| 2,775,774 | 1/1957 | Logan | 4/166 |
| 3,377,630 | 4/1968 | Robare | 128/66 X |
| 3,413,660 | 12/1968 | Lagarelli et al. | 4/166 |

FOREIGN PATENTS OR APPLICATIONS

| | | | |
|---|---|---|---|
| 882,470 | 7/1953 | Germany | 128/249 |
| 497,869 | 5/1930 | Germany | 4/167 |
| 923,977 | 4/1963 | United Kingdom | 128/249 |

*Primary Examiner*—Robert S. Ward, Jr.
*Attorney, Agent, or Firm*—Hill, Gross, Simpson, Van Santen, Steadman, Chiara & Simpson

[57] ABSTRACT

A portable molded plastic housing contains a reservoir of wash liquid such as water spaced above a basin having two opposed liquid spray nozzles. The nozzles are normally capped by an elastic cap over each, the two caps being joined by a strap by which fast and simultaneous removal of the caps is accomplished upon emergency need. The reservoir feeds solely by gravity to the nozzles upon removal of the caps. Liquid within the reservoir attains room temperature to improve user comfort and is free from contamination by pipe scale, yet is instantly available at a work station to give several minutes of eye-flushing spray.

13 Claims, 7 Drawing Figures

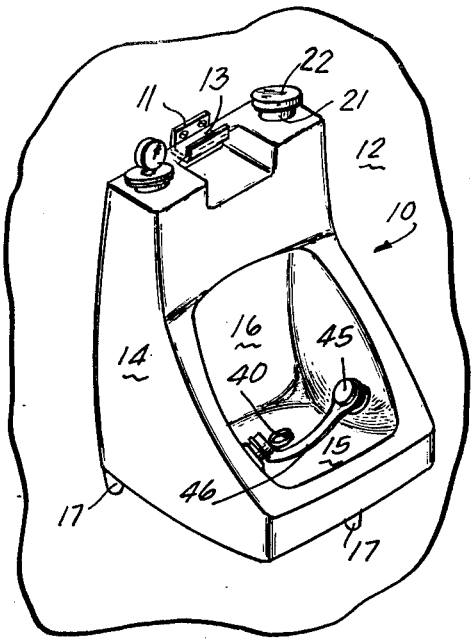
Fig. 1
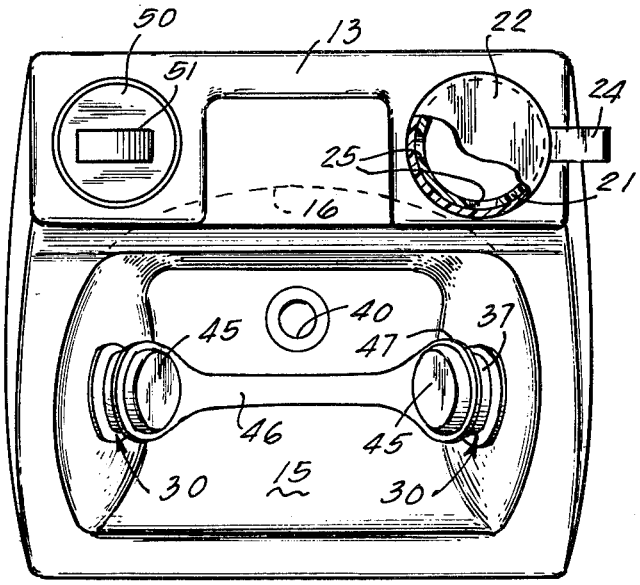
Fig. 2
Fig. 3
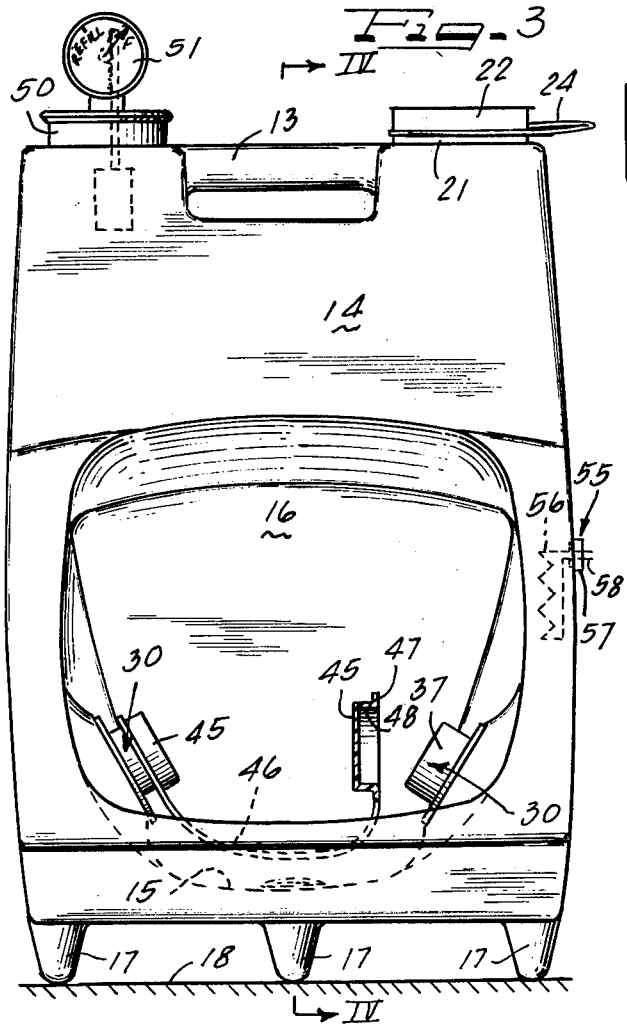
Fig. 4
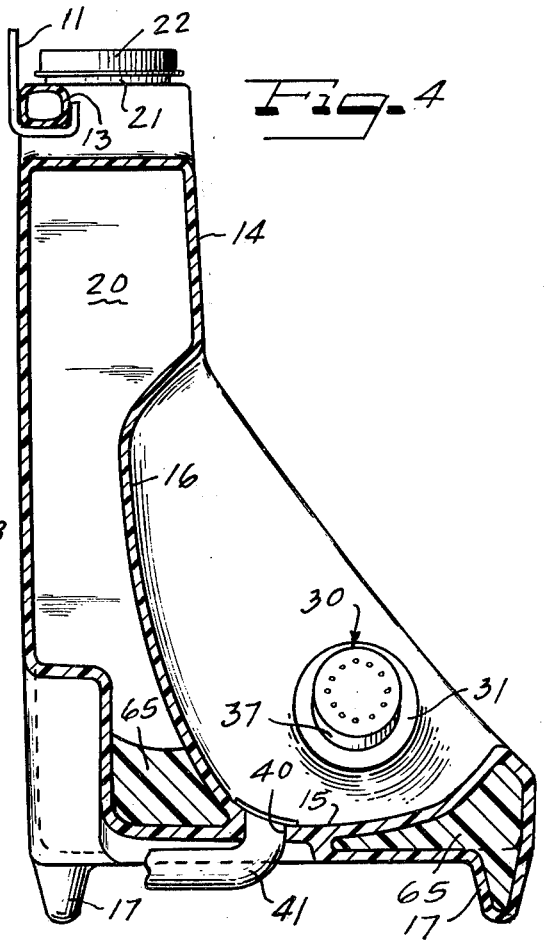

PORTABLE EMERGENCY EYE WASH FOUNTAIN

BACKGROUND OF THE INVENTION

1. Field of the Invention

The present invention relates to water fountains and especially to an eye wash fountain for emergency use at industrial work stations.

2. The Prior Art

Industries are increasingly aware of the need for protecting the health and safety of workers and particularly their eye sight where workers are exposed to gaseous fumes and liquids and solid materials which can irritate or injure eyes upon contact therewith. Prior art devices have employed eye wash fountains providing sprays of water from regular plant plumbing connections. However, use of emergency fountains is normally infrequent, and a long period of non-use often results in drying of nozzle structures, valves and supply conduits leading thereto by natural evaporation. Scale and corrosion builds up in unused pipes and can increase injury if sprayed into the eyes. Water in a plumbing system will often be at a different temperature than a room; unusually cold or warm water can be uncomfortable or even injurious to the user of an eye wash fountain. Special plumbing connections to the prior art devices increase the expense of installation of such units, thereby decreasing their availability to workers. Among particular prior art devices, U.S. Pat. No. 3,809,315 discloses nozzle means for reducing the velocity of an eye spray and for preventing surging of water upon initial opening of a valve. U.S. Pat. No. 3,629,876 discloses an eye wash fountain having integral nozzles in a basin with valves located on opposite sides of the basin for activation by leaning thereupon. U.S. Pat. No. 3,413,660 discloses an eye wash fountain having retractable cover members over nozzle outlets for protecting such outlets from deposits of airborne foreign matter.

SUMMARY OF THE INVENTION

It is an object of the invention to provide a low cost emergency eye wash fountain which is portable and requires no plumbing connections yet provides an instantly-available flow of uncontaminated wash fluid in a spray of sufficient volume and duration at room temperature and at a safe pressure to flush contaminates from a worker's eyes. A further object is to provide an emergency safety eye wash fountain wherein the worker can quickly turn on the water flow, by a readily accessible valve arrangement which can be reached by feel alone, and where the eye wash liquid is uniformly and gently directed broadly to the eyes of the worker.

In accordance with the invention, an eye wash fountain has a liquid reservoir in a portable housing which is open at its upper portion to atmospheric pressure. A pair of generally opposed spray nozzles are fixed in a lower portion of the housing in communication with the reservoir. A basin is formed in the housing between and below the nozzles and has a drainage port. The nozzles are blocked and covered prior to filling of the reservoir with liquid, and while awaiting use, by caps overlying each of the nozzles and joined together by a strap. Each cap forms a liquid-tight seal over each nozzle. A strap joining the two caps extends across the basin; grabbing the strap and yanking it outwardly releases the caps from the nozzles and permits a gravity-induced spray of washing liquid.

BRIEF DESCRIPTION OF THE DRAWINGS

FIG. 1 is a general perspective view of an eye wash fountain of the present invention.

FIG. 2 is a top plan view of the fountain, partly in section.

FIG. 3 is a front plan view of the fountain upon a flat surface.

FIG. 4 is a side sectional view on line IV—IV of FIG. 3.

DESCRIPTION OF THE PREFERRED EMBODIMENTS

Figure 5:
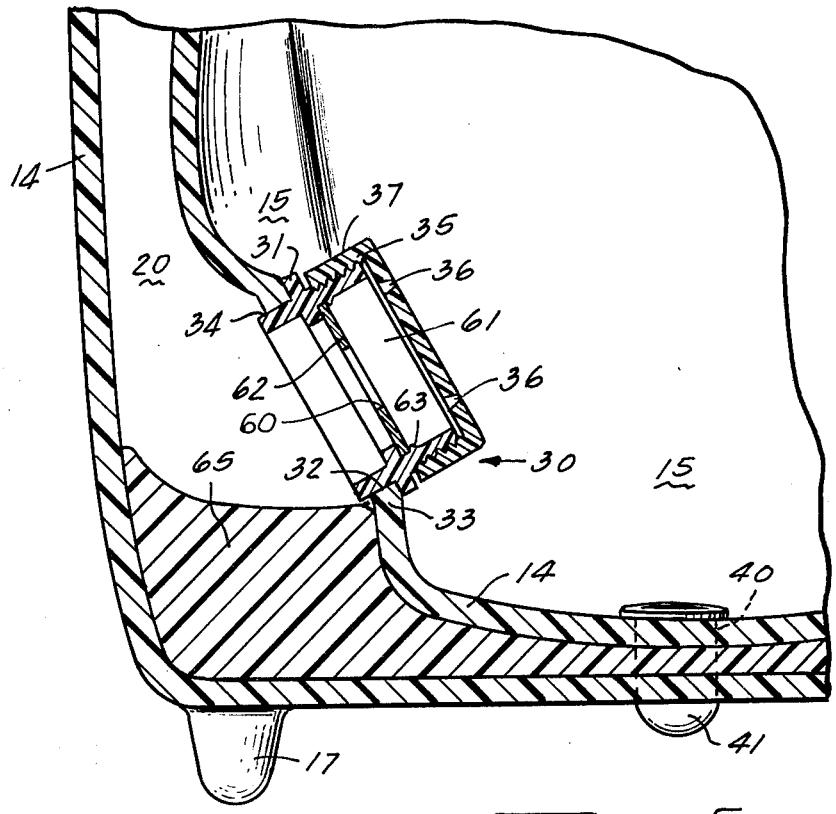
FIG. 5 is a sectional view of the filler cap and vent of the device.

An emergency eye wash fountain which is portable and independent of any plumbing connections as shown generally at 10 in FIG. 1. The fountain 10 as shown is suspended from a bracket 11 mounted upon a wall 12 near a work station via a carrying handle 13 formed in an upper part of a one-piece molded housing 14. The housing 14 has formed in a lower part thereof a basin 15 and a recess 16, both sized to receive thereinto the head of a user. A lower portion of the housing 14 is fitted with three round feet 17 so that the unit may rest stably upon a flat surface 18 despite molding irregularities in the bottom of the housing 14.

As shown in FIG. 4, the interior of the housing 14 is hollow, forming a reservoir 20 in which wash liquid is held until a need for use arises. The reservoir 20 is filled via an opening in a filling neck 21 at the top of the housing 14. The filler neck 21 is covered by a plastic cap 22 which is retained about the neck 21 by an integral ring 23 affixed to the cap 22 by a hinge portion 24. Vent indentations 25 assure that the reservoir 20 is open to atmosphere, but such vents are covered by the cap 22 to prevent entry of contaminating particles thereinto.

Figure 6:
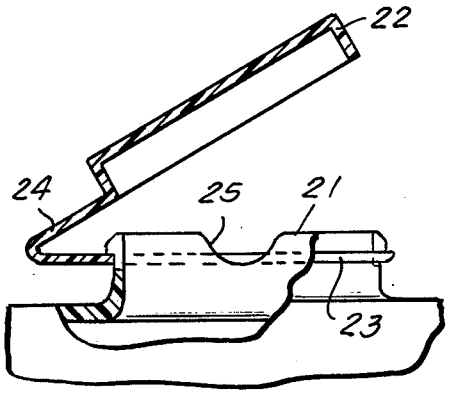
FIG. 6 is a sectional view through a nozzle of the present invention.

A pair of nozzles 30, 30 are provided in the housing 14 on opposite sides of the basin 15. Each nozzle 30 is angled somewhat upwardly, as is conventional in the art, to provide a direct flushing and bathing action for the eyes of a user. As shown in FIG. 6, each nozzle 30 comprises a mounting portion 31 which fits into an aperture 32 drilled through the housing 14 at the center of a projection 33 provided for such purpose. The mounting portion 31 is preferably press-fit into the aperture 32 until an annular ring 34 formed on the part 31 engages the interior of the housing 14. A nozzle part 35 is threadedly received upon the mounting part 31, the nozzle part 35 having plurality of spray apertures 36 formed therein. The press fit and threaded connections may alternatively be glued connections. An outer circumferential wall 37 of the nozzle plate 35 forms a liquid sealing surface, as described below.

In the bottom of the basin 15 is formed a drain aperture 40 to dispose of water collected in the basin 15. The aperture 40 may either drain freely or may be fitted with a hose 41 to carry collected liquid to a remote disposal point.

Figure 7:
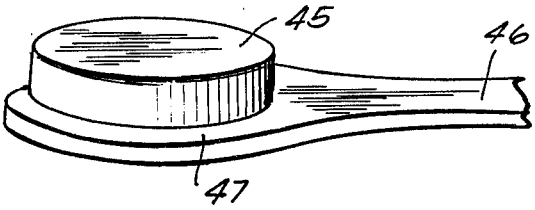
FIG. 7 is a perspective view of a portion of the grab strap and one nozzle cap of the present invention.

Control of flow from the nozzles 30, once the reservoir 20 is filled is accomplished by means of nozzle cover caps 45, 45 which are joined by a strap 46. As depicted in FIG. 7, the strap 46 extends about a lower periphery of each cap 45 in a band 47. Such construction provides additional sealing force upon an inner surface 48 of the cup 45 for engagement with the sealing wall 37 of the nozzle 30, and also precludes tearing of the strap 46 away from one or both of the caps 45 upon yanking of the strap 46 upon emergency need.

Other features of the invention are shown in the various Figures. Although the material of the housing 14 is generally translucent, so that the level of liquid in the reservoir 20 may readily be determined by inspection in most instances, it is desirable for some applications to provide a more readily visible indication of fill level. For such purposes a gauge port 50 is provided at the top of the housing 14. The port 50 may be drilled to receive any standard float gauge having for instance a two-to-four inch throw between refill and full levels. Liquid will escape from the reservoir 20 only by evaporation through the air vents 25, besides by use of the fountain, so only a few inches difference in liquid level need be indicated.

Provision for electric heating may be provided in a wall of the housing 14, as shown at 55 in FIG. 3. An immersion type heater coil 56 is provided, having a head 57 which is sealably engageable with the housing wall for receiving current from a thermostatcontrolled source of electrical energy. Such heating unit 55 will be required in some applications to prevent water in the reservoir 20 from freezing; it may also be desirable in other applications to provide wash fluid of a comfortable temperature. Normally, however, it is a feature of the present invention that liquid within the reservoir 20 reaches room temperature within a short period after being placed within the housing 14 and the fountain 10 being placed in a position near a work station. A room temperature wash is desirable in comparison to cold water washes provided from plumbed wash fountains of the prior art.

It is also a feature of the present invention that the nozzles 30 may be fitted upstream of the spray apertures 36 with a restricting orifice 60. In one form of the invention, in which the spray apertures 36 are directly in communication with the reservoir 20, removal of the caps 45 upon the nozzles 30 causes an initially quite strong flow where water level in the reservoir 20 is high, but such flow decreases steadily as the water level falls. An orifice 60 will restrict the flow to the spray apertures 36 by causing a pressure drop between the reservoir 20 and a chamber 61 just upstream of the apertures. The orifice 60 comprises simply a flat disc 62 having the orifice 60 in the center thereof. An annular ridge 63 within the nozzle mounting part 31 captures the orifice disc 62 in press-fit relationship. With the orifice 60 fitted, spray through the apertures 36 is substantially constant from initiation of flow until the reservoir 20 is substantially exhausted.

It is further contemplated that the strap 46 may be so arranged that as the user moves his head unto the emergency wash zone his head will engage the strap pulling the caps off of the nozzles. This can be accomplished, for example, by positioning the nozzles, by having the strap run upwardly through loops on the sidewalls of the eye wash space to elevate the strap loop.

Finally, it is contemplated by the present invention that the bottom portion of the housing 14 may be filled with a nonporous foam 65, which fills the space below the nozzles 30 and avoids retention of standing water therein. Such foam also weights the bottom of the housing even when the fountain is empty of liquid and increases the rigidity of the housing.

In operation, the fountain 10 is conveniently portable by means of its carrying handle 13. The handle is adapted to be engaged by a mounting bracket 11 which may readily be affixed to a wall 12 near a work station, or the fountain 10 may be placed upon a flat surface 18, resting upon the feet 17. Either before or after placement in position accessible to workers subject to eye contamination, the reservoir 20 is filled with approximately five gallons of water or similar solution through the fill opening 21. Then the cap 22 is closed over the opening 21 to prevent entry of foreign particles. The nozzle caps 45 prevent deposit of foreign particles upon the nozzles 30 and any leakage of liquid from the reservoir 20 until they are removed. Removal of the caps 45 is quickly accomplished by an injured worker grabbing the strap 46 and pulling it towards him, uncovering the spray apertures 36 and initiating a gravity-induced flow of wash liquid inwardly and upwardly above the basin 15. The worker will then place his head into the recess 16 above the basin 15 so that his eyes are washed by the spray of wash liquid. The flow of liquid will continue for three and one half minutes if no orifice 60 has been placed in the nozzles, or for a longer period of time if an orifice 60 is present. Such wash period is sufficient for flushing of foreign substances, in most instances. After use, the caps 45 and strap 46 may be left loose in the basin 15, indicating that the fountain has been used and should be refilled promptly.

Although various minor modifications may be suggested by those versed in the art, it should be understood that I wish to embody within the scope of the patent warranted hereon all such modifications as reasonably and properly come within the scope of my contribution to the art.

I claim as my invention:

1. An emergency safety eye wash fountain comprising spray nozzle means positioned at a location for spraying the eyes of a worker and comprising:

a portable, unitary housing;

said housing having wall means defining an unpressurized liquid reservoir in said housing;

said nozzle means being located in said wall means in immediate fluid communication with said reservoir;

said resevoir being located gravitationally above said nozzle means; and quick-release valve means for opening said nozzle means for instantaneous initiation of a continuing, drenching flow of eye wash liquid from said reservoir.

2. A fountain as defined in claim 1, said fountain further having a carrying handle atop the reservoir to facilitate manual portability and for hanging placement thereby near a work station.

3. A fountain as defined in claim 1, further comprising a basin area formed integrally in said fountain housing below and between said nozzles.

4. An emergency safety eye wash fountain comprising spray nozzle means positioned at a location for spraying the eyes of a worker and comprising:

an unpressurized liquid reservoir in fluid communication with said nozzle means and located gravitationally above said nozzle means;

quick-release valve means for opening said nozzle means for instantaneous initiation of a continuing, drenching flow of eye wash liquid from said reservoir; and wherein said quick-release valve means comprises an elastic nozzle cover cap, a strap connected to said cap positioned to be normally engaged by the worker and pulled from the nozzle means upon engagement, the cap being engageable about said nozzle means and sealing said nozzle means to prevent any flow of liquid from said reservoir until removal of said cap.

5. A fountain as defined in claim 4, wherein said strap is formed integrally with said cap and has a reinforcement band about a circumference of said cap at a lower portion thereof, thereby to assure a tight elastic seal about each nozzle and positive removal of said caps upon yanking of the strap by a user.

6. An apparatus for producing upon emergency demand a continuing flow of liquid for flushing body tissues, said apparatus comprising:

an unpressurized reservoir containing said liquid;

a nozzle in fluid communication with said reservoir, said nozzle being located below said reservoir for gravity-feed of liquid thereto; and flow control means for initiating a flow of liquid through said nozzle;

said flow control means comprising a removable cap placed over an outlet aperture of said nozzle, said cap being quickly removable by a user in an emergency.

7. An apparatus for producing upon emergency demand a continuing flow of liquid for flushing body tissues, said apparatus comprising:

an unpressurized reservoir containing said liquid;

a nozzle in fluid communication with said reservoir, said nozzle being located below said reservoir for gravity-feed of liquid thereto; and flow control means for initiating a flow of liquid through said nozzle;

a flow control orifice placed between said nozzle and said reservoir, the orifice maintaining a substantially constant rate and pressure of flow through the nozzle despite a decrease in pressure head due to drop in liquid level in said reservoir until said reservoir is substantially exhausted.

8. An emergency eye wash fountain comprising, in combination:

a portable housing;

a liquid reservoir in said housing open at an upper portion thereof to atmospheric pressure;

a pair of generally opposed spray nozzles affixed in a lower portion of said housing, each nozzle being in fluid communication with said reservoir;

a basin formed in said housing between and below said nozzles, said basin having a drainage aperture formed in a lowermost position thereof;

a recess formed in said housing above and behind said basin of a size sufficient to permit placement of a user's head thereinto with his eyes in a line of spray between the nozzles during use; and quick release flow control caps overlying each of said nozzles and removeable upon need to initiate liquid spray.

9. A fountain as defined in claim 8, further comprising:

a flow-restricted orifice upstream of each of the nozzles, the orifice maintaining a near-constant rate of flow despite variation in liquid head pressure.

10. A fountain as defined in claim 8, further comprising:

a handle means on an upper portion of said housing to facilitate manual carrying of said fountain and suspension of said housing upon a vertical surface near a work station.

11. A fountain as defined in claim 8, further comprising:

a reservoir liquid level indication means extending from said reservoir into a visible location outside said housing.

12. A fountain as defined in claim 8, further comprising:

electric temperature control means selectively activatable to maintain reservoir temperature at a comfort level above ambient temperature.

13. An emergency eye wash station for spraying water into a user's eyes comprising:

a pair of spaced opposed spray nozzles defining a wash zone therebetween;

a container open to atmosphere extending above the nozzles and in communication therewith for supplying water at room temperature;

elastic caps elastically held to block the spray nozzles and removable therefrom by a user of said fountain; and a strap extending across the wash zone for manual engagement by the user to immediately initiate room temperature drenching spray into the wash zone.

* * * * *